United States Patent [19]

Cowles

[11] Patent Number: 4,896,707

[45] Date of Patent: Jan. 30, 1990

[54] ADJUSTABLE, DISPOSIBLE FUNNEL

[76] Inventor: Stanley P. Cowles, 2128 E. Woodman Dr., Tempe, Ariz. 85283

[21] Appl. No.: 135,673

[22] Filed: Dec. 21, 1987

[51] Int. Cl.[4] ..... B67C 11/00; B65B 39/02

[52] U.S. Cl. ..... 141/337; 141/391; 493/932; 493/296

[58] Field of Search ..... 141/390-392, 141/337, 338, 331; 493/960, 968, 932, 931, 296

[56] References Cited

U.S. PATENT DOCUMENTS

| | | | |
|---|---|---|---|
| 1,911,671 | 5/1933 | Blauvelt | 423/296 X |
| 2,100,888 | 11/1937 | Vine | 141/337 |
| 2,158,688 | 5/1939 | Brooks | 141/337 |
| 2,321,639 | 6/1943 | Zarbo | 141/331 |
| 2,330,460 | 9/1943 | Waldrip et al. | 423/296 X |
| 2,605,582 | 8/1952 | Allen | 141/391 |
| 3,572,318 | 3/1971 | Garland | 141/337 |
| 4,062,387 | 12/1977 | Peniche | 141/337 |
| 4,108,222 | 8/1978 | Kaufman | 141/337 |

FOREIGN PATENT DOCUMENTS

| | | | |
|---|---|---|---|
| 2497786 | 7/1982 | France | 141/337 |

*Primary Examiner*—Ernest G. Cusick
*Attorney, Agent, or Firm*—James F. Duffy

[57] ABSTRACT

A sheet of flexible material may be hand formed into a selected, conic, funnel shape; maintained in that shape while utilized as a funnel; then disposed of. A kit containing a quantity of such sheets provides ease of transport and ready access to a multiplicity of disposable funnels of various selected sizes.

7 Claims, 1 Drawing Sheet

ADJUSTABLE, DISPOSIBLE FUNNEL

FIELD OF THE INVENTION

The invention relates to the field of funnel devices. In particular, the invention relates to funnels that are adjustably formed to a selected size, with respect to input and output orifices, and which are economical enough to dispose of after use. Specifically, the invention refers to a flat, flexible sheet, with coupling mechanism attached, utilized to form and maintain a selected funnel shape.

PRIOR ART

As frequently happens when one needs a funnel, there is no funnel available, or, the funnel found is not the right size for the task at hand. Oftentimes it is inconvenient, and perhaps dangerous, to retain a funnel after it has been used. Such an instance might arise after using a funnel to pour a pesticide. Another would arise when the funnel had been used in pouring oil or hydraulic fluid for car maintenance. It is seldom convenient to clean an oily funnel; and storing one in the car is messy as well as dangerous.

There is a need for means to permit the ready, hand formation of funnels of various selected sizes; which means may be conveniently stored and transported, and which produces funnels at such low cost that they may be economically disposed of after use.

Certain U.S. Patents are of interest. The patent to Peniche, No. 4,062,387, issued Dec. 13, 1977 for DISPOSABLE FUNNEL APPARATUS. The disclosure there is of a preformed assembly of two sheets. The size of the funnel is not determinable by the user, as is the case of the instant invention.

The patent to Kaufman, No. 4,108,222, issued Aug. 22, 1978 for COLLAPSIBLE DISPOSABLE FUNNEL. There the disclosure is again that of of an already assembled funnel which, while disposable, permits the user no choice in determining the size of the funnel. Neither of these disclosures would lead one skilled in the art to conceive of, investigate, and reduce to practice the invention taught herein. They are referenced as being of background interest only.

SUMMARY

The invention may be summarized as conveniently stored means for the ready, hand production of adjustable, disposable funnels. It comprises a sheet of nominally planar material of sufficient flexibility to be hand rolled to a selected, conic, funnel shape with means coupled to the sheet for maintaining the nominally planar material in the selected shape.

Disclosed embodiments of the invention include a plurality of the sheets of nominally planar material and package means for transporting and storing the sheets therein.

An embodiment of the invention is disclosed wherein the means for maintaining the selected, conic, funnel shape comprises an exposably covered adhesive strip affixed to a first portion of the sheet for making adhering contact with a selected second portion of the sheet when the sheet is rolled to the selected funnel shape.

Other embodiments are disclosed wherein the sheets of material are generally rectangular in shape, and the adhesive strip is affixed oblique one corner thereof. And there is an embodiment wherein the sheets of material are generally rectangular in shape but with a selected corner of the sheet deleted therefrom. The adhesive strip is affixed to the sheet along the edge defined by the deletion of the selected corner.

The invention is also disclosed as a kit for conveniently storing means for the ready, hand production of adjustable, disposable funnels. The kit is disclosed as comprising a plurality of sheets of nominally planar material, each sheet being of sufficient flexibility to be hand rolled to a selected, conic, funnel shape, there being means coupled to each of the sheets for maintaining the nominally planar material in the selected funnel shape, and package means for transporting and storing the plurality of the sheets therein. The means for maintaining the selected funnel shape comprises an exposably covered adhesive strip affixed to a first portion of the sheet for making adhering contact with a selected second portion of the sheet when the sheet is rolled to a selected funnel shape.

The methodology of the invention is set forth as the method of preparing and storing means for the ready, hand production of adjustable, disposable funnels comprising the steps of:

a. procuring generally planar sheets of a material that is flexible enough to be readily hand formed into a conic, funnel shape;
b. affixing a covered, exposable, adhesive strip to a portion of each of the sheets such that when any one of the sheets is hand formed into a conic, funnel shape, the adhesive strip may be uncovered to adhere itself to another portion of the sheet and thereby maintain the sheet in the form of a conic, funnel shape; and
c. assembling a quantity of the sheets with, adhesive strips attached, for convenient storage and ready accessibility for forming selected ones of the sheets into conic, funnel shapes as need arises.

Further methodical disclosure is provided wherein the step of assembling a quantity of the sheets (step c) further comprises the step of:

d. packaging the sheets for ease of transport and storage.

The products produced by practice of the innovative processes are claimed.

For the purposes of this disclosure a "conic" shape is defined as encompassing conical and pyramidal shapes, and tapered shapes in general.

DETAILED DESCRIPTION OF THE INVENTION

Figure 1:
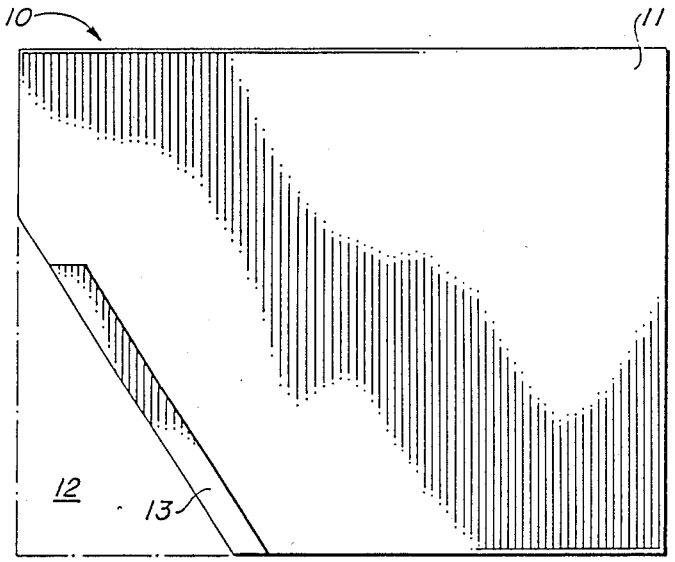
FIG. 1 illustrates the invention, unformed, ready for hand forming into a funnel of selected size.

For purposes of promoting an understanding of the principles of the invention, reference will now be made to the embodiments illustrated in the drawings and specific language will be used to describe same. It will nevertheless be understood that no limitation of the scope of the invention is thereby intended, there being comtemplated such alterations and modifications of the illustrated device, and such further applications of the principles of the invention as disclosed herein, as would normally occur to one skilled in the art to which the invention partains.

The invention 10 is depicted in FIG. 1 as a generally rectangular shaped sheet of flexible material 11. Sheet 11 is flexible enough to be hand formed into a selected, conic, funnel shape. By way of illustration and not of limitation, the material of sheet 11 may comprise paper, plain or coated; plastic film or sheet; or similar flexible materials of sufficient rigidity to nominally maintain a shape to which it is formed.

It will prove advantageous to form sheet 11 into a conical shape for use as a funnel. For efficiency then, a corner 12 of the generally rectangular outline of sheet 11 may be deleted. For further efficiency, a coupling mechanism 13, for maintaining sheet 11 in a selected funnel shape, is affixed obliquely to sheet 11, as illustrated in FIG. 1. Why these efficiencies obtain will be disclosed in the course of the exposition which follows.

Figure 2:
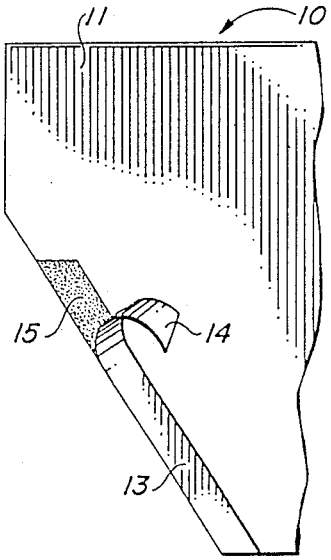
FIG. 2 shows the adhesive strip coupled to the invention to be used to maintain the selected funnel shape.

In FIG. 2, the coupling mechanism 13 is seen to be an exposibly covered adhesive strip assembly comprised of adhesive strip 15 and removable cover 14. Coupling assembly 13 is affixed to sheet 11 such that removal of cover strip 14 exposes the tacky surface of adhesive strip 15. When sheet 11 is hand formed so as to bring the exposed adhesive strip 15 into adhering contact with another portion of sheet 11, the sheet will nominally maintain the shape it had assumed when the exposed surface of adhesive strip 15 contacted that other portion of the sheet.

Sheet 11 is flexible enough to be hand formed into a desired shape. To "nominally maintain" that selected shape means that that shape will be maintained until sheet 11 is subjected to a deforming force which reforms the flexible sheet into a new shape. The conic, funnel shape and the adhesive coupling strip further cooperate to maintain sheet 11 in a shape that may effectively be utilized in the course of transferring liquids from one container to another.

Figure 3:
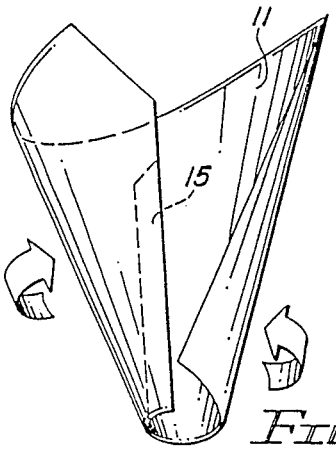
FIG. 3 indicates the manner in which the flexible sheet of the invention is manipulated to form a funnel.
Figure 4:
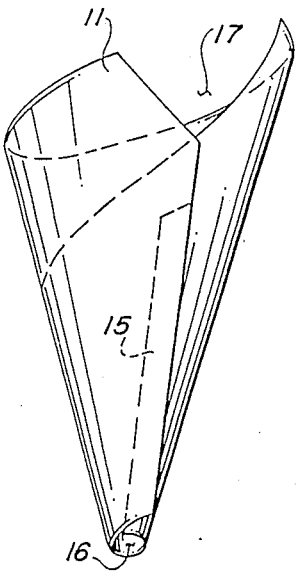
FIG. 4 is a side elevation view of the invention formed into a funnel shape and maintained in that shape by the coupled adhesive strip.

The manner of forming a planar sheet into a conic shape is well known. In FIG. 3, the arrows indicate the general movement of sheet 11 required to form it into a conic, funnel shape. The selected shape is illustrated in FIG. 4. Here the efficiency of applying adhesive coupling assembly 13 obliquely to sheet 11 is made obvious.

As seen in FIG. 4, adhesive strip 15 lies along, or lies closely adjacent, a straight line on the surface of the funnel shaped sheet 11, rather than forming a spiral line about the surface of the funnel shape. It is thus apparent that less adhesive is required than would have been needed if, for instance, the adhesive strip were applied along the edges shown in dashed outline in FIG. 1.

Since it is more efficient to maintain the dashed edges of sheet 11 free of adhesive, removal of corner 12 of the sheet implies a further efficiency in that the loose corner need not be manipulated in forming sheet 11 into a funnel shape; and no mechanism is required to maintain the unneeded corner in position. When corner 12 is removed, FIG. 2, the adhesive coupling assembly 13 is affixed along the oblique edge of sheet 11 defined by the removal of corner 12 (FIG. 2).

Figure 5:
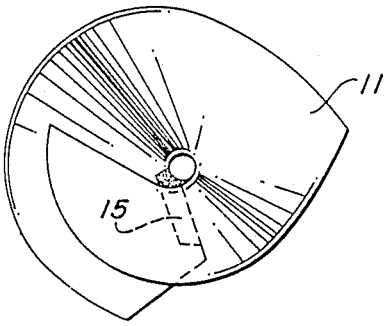
FIG. 5 is a plan view of the funnel of FIG. 4 looking into the top, or input orifice, thereof.

A person forming sheet 11 into the funnel shape of FIG. 4 is free to select the size of the funnel output orifice 16 as well as the funnel input orifice 17. Once the selected funnel shape of sheet 11 is achieved, adhesive strip 15 is brought into adhering contact with the adjacent portion of the sheet forming the funnel. The selected funnel shape will then be maintained. FIG. 5 illustrates a view taken looking down into the input orifice 17 (FIG. 4) of the formed funnel.

Figure 6:
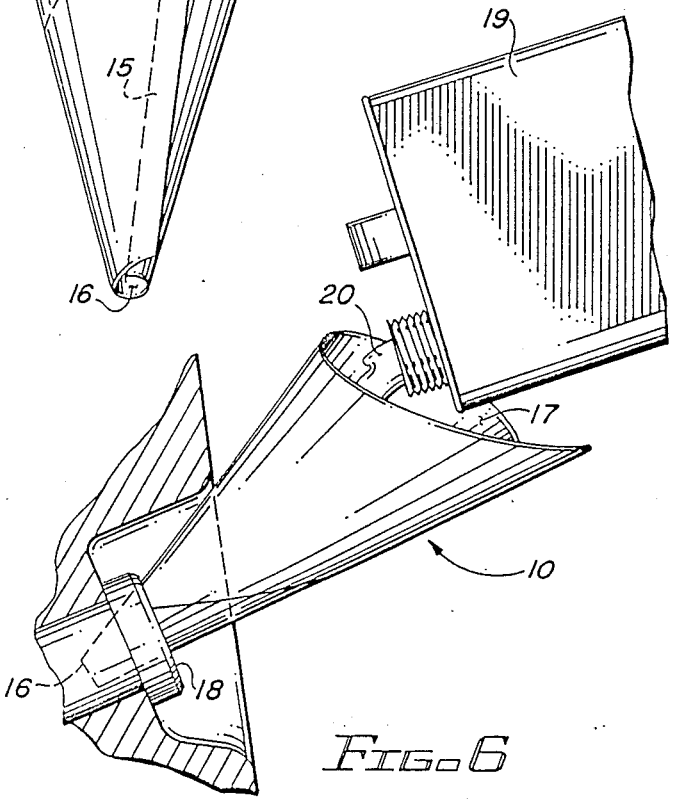
FIG. 6 illustrates the use of the funnel of FIG. 4 in transferring a liquid from one container to another.

FIG. 6 illustrates the manner in which sheet 11, formed into a selected, conic, funnel shape, is utilized to transfer liquid 20 from a container 19 into the input orifice 18 of a second container (not shown in the illustration).

Figure 7:
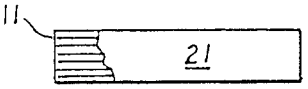
FIG. 7 is a side elevation of a package in which the flexible sheets of the invention may be transported and stored.

The invention 10 is intended to provide a person with a convenient source of disposable funnels whose shape has been adjusted to a selected funnel size. Since the funnels are intended for disposal after use, the need arises for a source of a quantity of sheets 11 with attached adhesive coupling assemblies 13. To this end a kit is here disclosed (FIG. 7) which is comprised of a quantity of said sheets 11 in a container 21. Container 21 permits sheets 11 to be transported and stored for convenient access. In a preferred embodiment, container 21 is the packaging in which sheets 11 are marketed.

What has been disclosed in the means and method whereby a sheet of flexible material may be hand formed into a selected, conic, funnel shape; maintained in that shape while utilized as a funnel; then disposed of. A kit containing a quantity of such sheets provides ease of transport and ready access to a multiplicity of disposable funnels of various selected sizes.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, That which is claimed is:

1. In a disposable funnel comprised of a generally rectangular, flexible, planar material formable by a user into a funnel shape and having adhesive affixed to said material for making adhering contact to a selected, relatively broad portion of said material to maintain said material in a user-selected funnel shape, the improvement for efficiently reducing the amount of adhesive necessary to maintain said user-selected funnel shape, said improvement comprising:

said adhesive being a relatively narrow adhesive strip, coupled obliquely to said material so as to lie in a generally straight line on a surface of a user-selected funnel shape, rather than forming a spiral line about the surface of said funnel shape, thereby efficiently reducing the amount of adhesive required to maintain said material in said user-selected funnel shape.

2. The improvement of claim 1 wherein said generally rectangular material has at least three sides one of which is oblique to the other two and said adhesive strip is coupled to said material along the oblique side of the material.

3. The improvement of claim 2 further comprising:

a plurality of sheets of said generally rectangular, flexible, planar material; and package means for transporting and storing said plurality of said sheets therein.

4. The improvement of claim 2 wherein said adhesive strip further comprises a covered adhesive strip for making adhering contact between selected portions of said generally rectangular material when said material is configured to said user-selected funnel shape.

5. Disposable funnel means comprising:

a sheet of nominally planar material of sufficient flexibility to be hand rolled to a user-selected funnel shape, said sheet being generally rectangular in shape and having at least three sides, one of which is oblique the other two; and adhesive means coupled to said sheet in a strip along the side oblique of the other two to generally lie on a straight line on a surface of said sheet, as opposed to lying on a curved, spiral path on the surface of said sheet, when said sheet is rolled to a user-selected funnel shape.

6. The disposable funnel means of claim 5 further comprising kit means for transporting and storing a plurality of said sheets with said adhesive means overlying each other.

7. The disposable funnel means of claim 5 wherein said adhesive means further comprises a covered adhesive strip for making adhering contact between selected portions of said sheet when said sheet is configured to a user-selected funnel shape.

* * * * *